US006185799B1

(12) United States Patent
Gay

(10) Patent No.: US 6,185,799 B1
(45) Date of Patent: Feb. 13, 2001

(54) FOLDING FASTENER FOR A STRAP

(75) Inventor: Jacques H. Gay, Geneva (CH)

(73) Assignee: Montres Rolex S.A., Geneva (CH)

( * ) Notice: Under 35 U.S.C. 154(b), the term of this patent shall be extended for 0 days.

(21) Appl. No.: 09/045,528

(22) Filed: Mar. 20, 1998

(30) Foreign Application Priority Data

Mar. 22, 1997 (CH) ..... 0680/97

(51) Int. Cl.[7] ..... A44C 5/24
(52) U.S. Cl. ..... 24/715
(58) Field of Search ..... 24/68 J, 70 J, 24/69 J, 71 J, 68 R, 71 R; 368/281–283

(56) References Cited

U.S. PATENT DOCUMENTS 1,756,769 * 4/1930 Tost .
3,521,331 * 7/1970 Gay .
3,913,182 * 10/1975 Fontana .
5,689,859 * 11/1997 Cuche .
5,771,543 * 6/1998 Froidevaux et al. .
5,781,968 * 7/1998 Widmer .

FOREIGN PATENT DOCUMENTS 347968 7/1930 (GB) .

* cited by examiner

*Primary Examiner*—James R. Brittain
(74) *Attorney, Agent, or Firm*—Lacasse & Associates

(57) ABSTRACT

The folding fastener for closing a strap contains a lockable, two-part folding clasp. A first strap half (7) is fixed to a first clasp part (1) and a second strap half (9) to a closure cover (5). A second clasp part (2) connects in rotary manner the first clasp part (1) to the closure cover (5). The clasp parts (1, 2) are substantially rigid with respect to longitudinal extension and/or bending. The locking mechanism comprises two claws (4.1, 4.2), which are fixed to the second clasp part (2) and two corresponding shapes (1.1, 1.2) on the first clasp part (1). In the locked state the claws (4.1, 4.2) engage over the shapes (1.1, 1.2) and consequently form the positive, reversible connection between the first clasp part (1) and the second clasp part (2). The folding fastener combines security with esthetics and requires no soldered joints.

25 Claims, 15 Drawing Sheets

Figure 1:
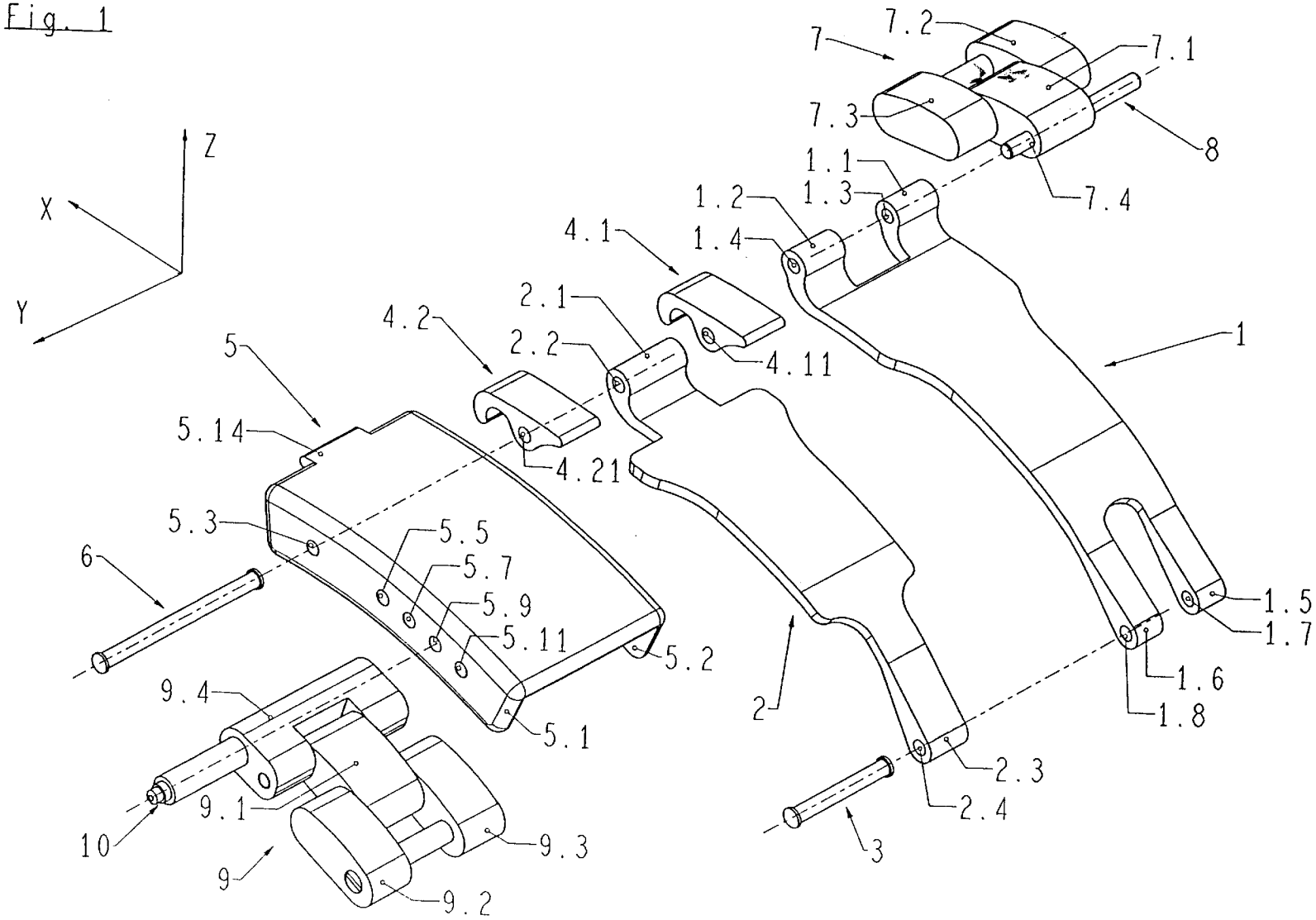

9
2
2.3
1.8
1.6
Z
X
1
5
5.14
7
5.12
5.11
5.9
5.7
5.5
4.2
4.22
2.1
5.3
1.4
4.11
1.2
5.13
1.5
9.3
9.2
Y
7.2
7.3

FOLDING FASTENER FOR A STRAP

The invention relates to a folding fastener according to the preamble of the independent claim. It more particularly relates to a folding fastener for fastening straps, such as e.g. used for wrist-watches.

Folding fasteners with two-part folding clasps for fastening straps are known. Each of the two clasp parts are interconnected in rotary manner at one of their ends by means of a pin. At the in each case other end the clasp parts are linked with in each case one strap half. In the closed state the two clasp parts are folded together and are substantially located on top of one another. They are held together by means of a closure cap through a snap closure. In the opened state the two clasp parts are folded out and increase the overall diameter of the strap, so that said strap can be drawn on and off with respect to the hand and wrist.

The known folding fasteners have very flat and therefore flexible, pliable clasp parts. Due to this flexibility the locking of the fastener can, under the action of certain forces and/or torques, become released in an undesired manner. The resulting lack of security is a disadvantage of known folding fasteners.

Another disadvantage of the hitherto known folding fasteners is that they can be opened through unintentional manipulation on the closure cover. The intention is that the folding fastener opens when the front end of the cover is raised, i.e. that end which points to 6 o'clock of a wrist-watch fixed to the strap. However in certain circumstances it is also possible to open a conventional folding fastener by lifting the rear end of the closure cover, i.e. that end which points to 12 o'clock. This is undesired and also reduces the security of the folding fastener.

In the case of certain known folding fasteners, individual components are soldered together. Soldering changes the quality and appearance of the metal in the vicinity of the soldered joint and metal, e.g. stainless steel can oxidize and soften in the vicinity of such joints, which is undesired.

The problem of the invention is to provide a folding fastener, which avoids the aforementioned disadvantages. It is intended to combine security and esthetics, whilst obviating the use of soldered joints.

This problem is solved by the folding fastener, as defined in the independent claim.

The folding fastener according to the invention has a two-part, lockable folding clasp and a closure cover or cap. The two clasp parts are thick, solid and therefore correspondingly rigid and dimensionally stiff. This avoids any expansion and/or bending of the clasp parts under external actions and the undesired release of the fastener locking system.

To a first clasp part is fixed a first strap half and to the closure cover is fixed a second strap half, whilst a second clasp part links the first clasp part with the said cover. The connections between the second clasp part and the first clasp part or the closure cover are rotary and are advantageously implemented by bolts, pins or hinges. To permit a locking of the folding fastener, the two clasp parts are also interconnectable in a positive, reversible manner by a locking mechanism. This positive, reversible connection is preferably in the form of a snap closure, e.g. by at least one claw on one free end of the second clasp part, which engages in slightly resilient, corresponding shapes on a free end of the first clasp part. The at least one claw is preferably so designed and positioned, that it prevents an opening of the folding fastener when the rear end of the closure cover is raised, which gives additional security against undesired opening.

Whereas in conventional folding fasteners the closure cover is important for locking purposes, it does not contribute thereto in the case of the folding fastener according to the invention. Its technical function is limited to an aid on opening the locking system and also provides a connection between the clasp and the second strap half. In addition, the closure cover has an esthetic function, namely that of hiding the clasp in the closed state. This gives rise to the impression that the strap passes continuously beneath the closure cover and is not interrupted by any fastener, as if the said cover was merely placed on the strap. In order to reinforce this elegant impression, when considered from above the claws can have the same appearance as the strap members. The closure cover can be open at both ends and only have on the sides wrapped round edges. Thus, the folding fastener according to the invention combines security and esthetics in an optimum manner.

Hereinafter preferred embodiments of the inventive folding fastener are described in detail relative to the drawings. In order to explain the invention, different views of the differently opened or broken-down folding fasteners are shown. In the drawings show:

FIG. 1 A perspective view of the essential components of the folding fastener, the latter being disassembled by lateral shifting of the components.

Figure 2:
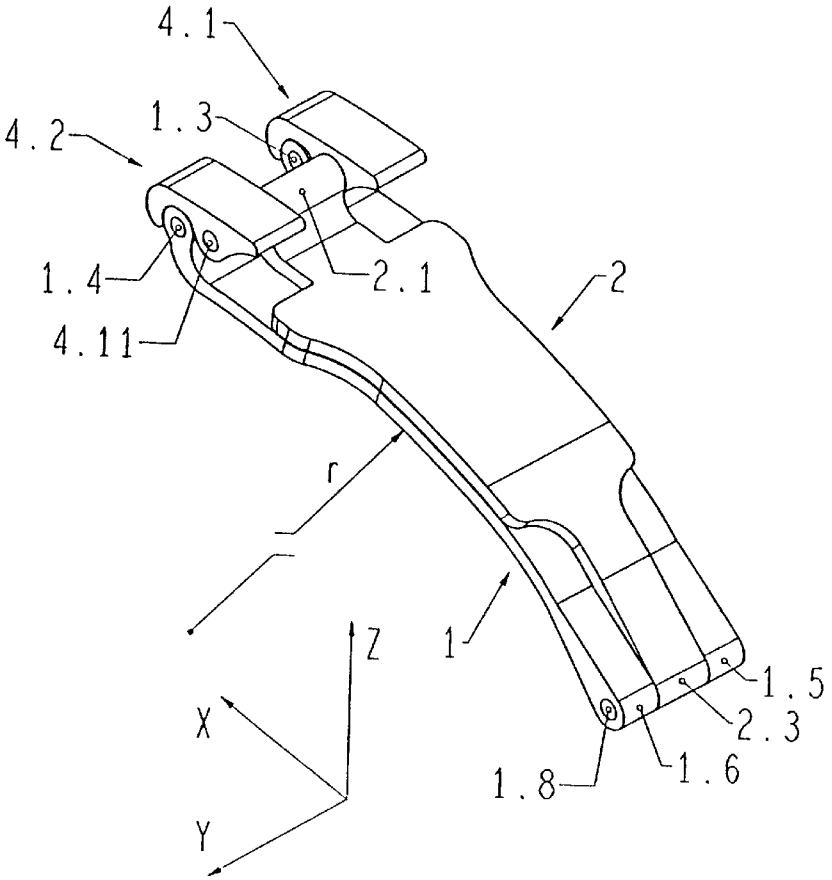

FIG. 2 A perspective view of the locked clasp with the locking mechanism.

Figure 3:
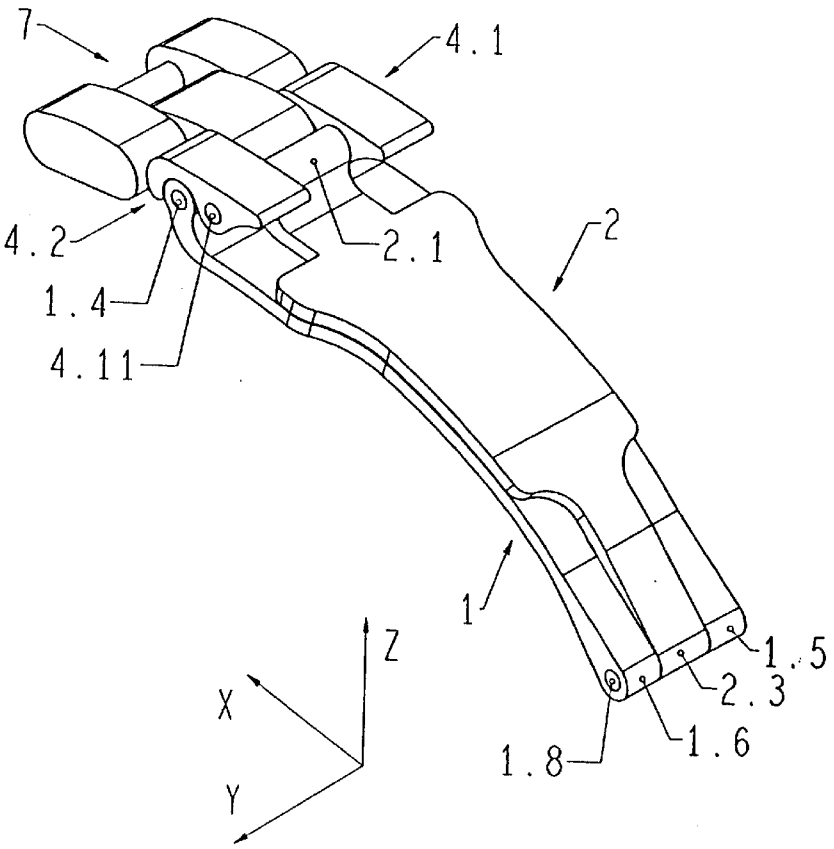

FIG. 3 Like FIG. 2, but with members of the second strap half.

Figure 4:
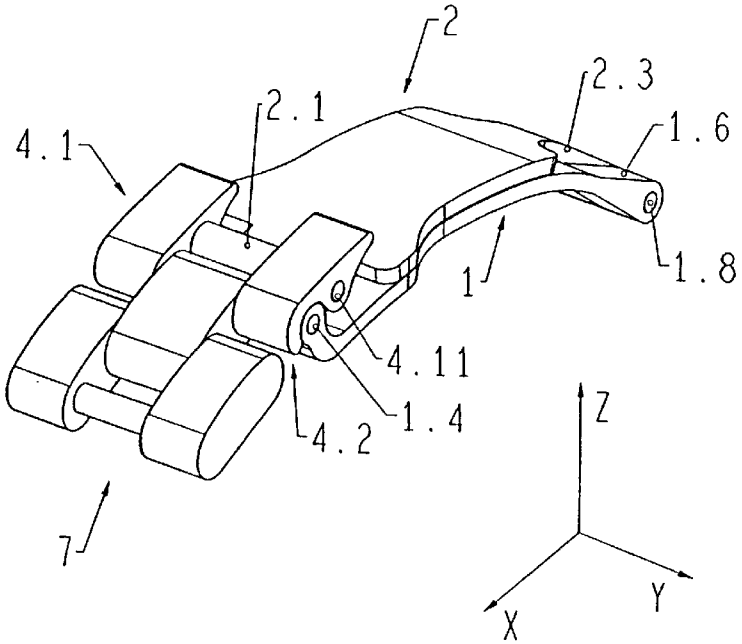

FIG. 4 Like FIG. 3, from a different perspective.

Figure 5:
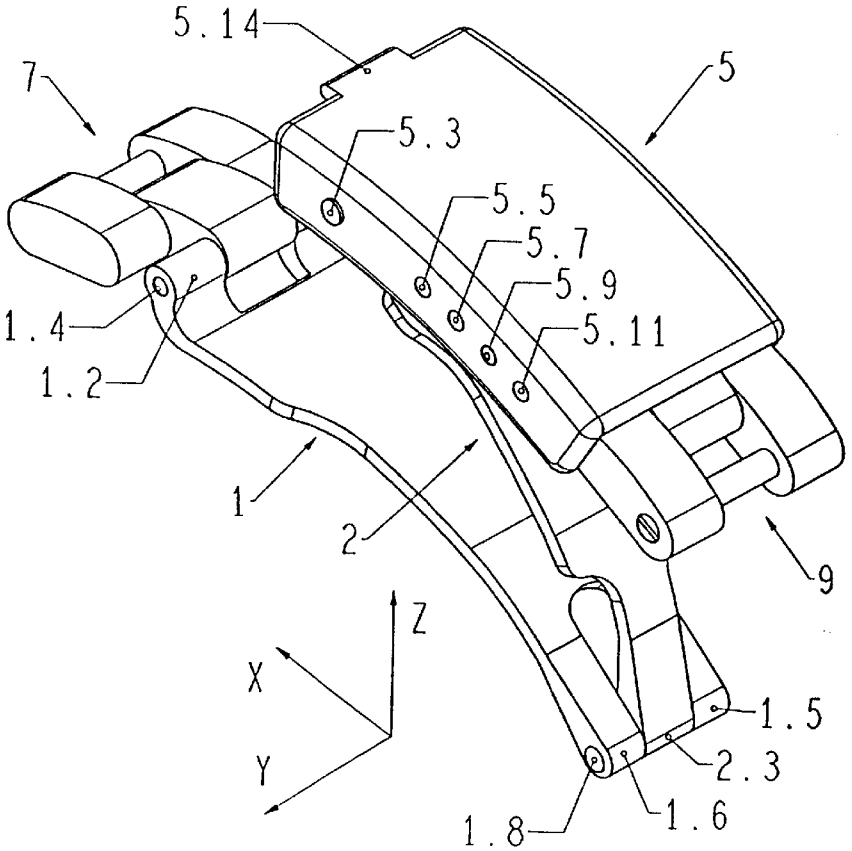

FIG. 5 A perspective view of the open folding fastener with strap members.

Figure 6:
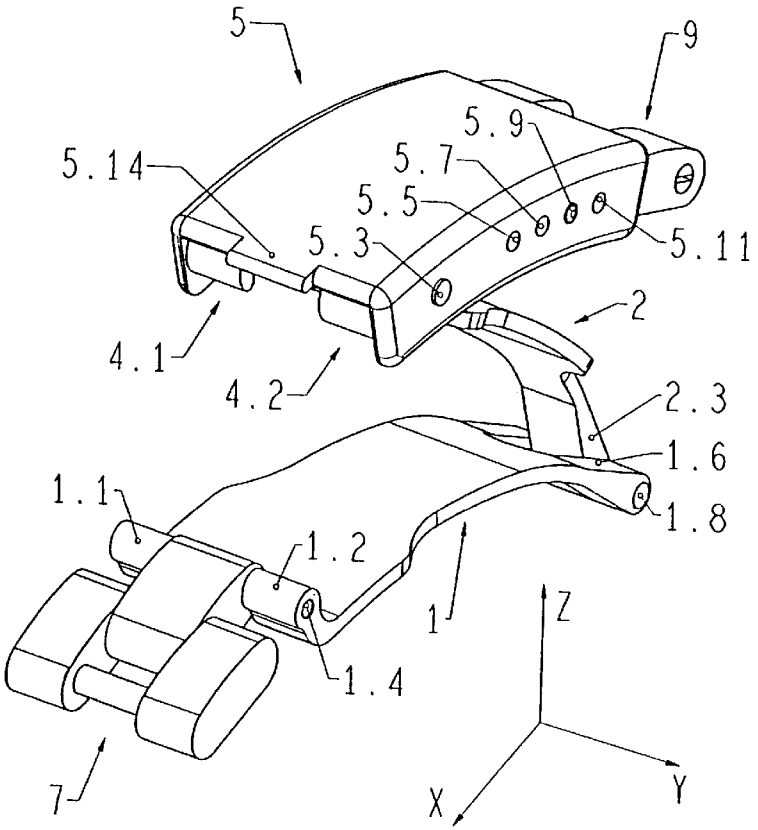

FIG. 6 Like FIG. 5, from a different perspective.

Figure 7:
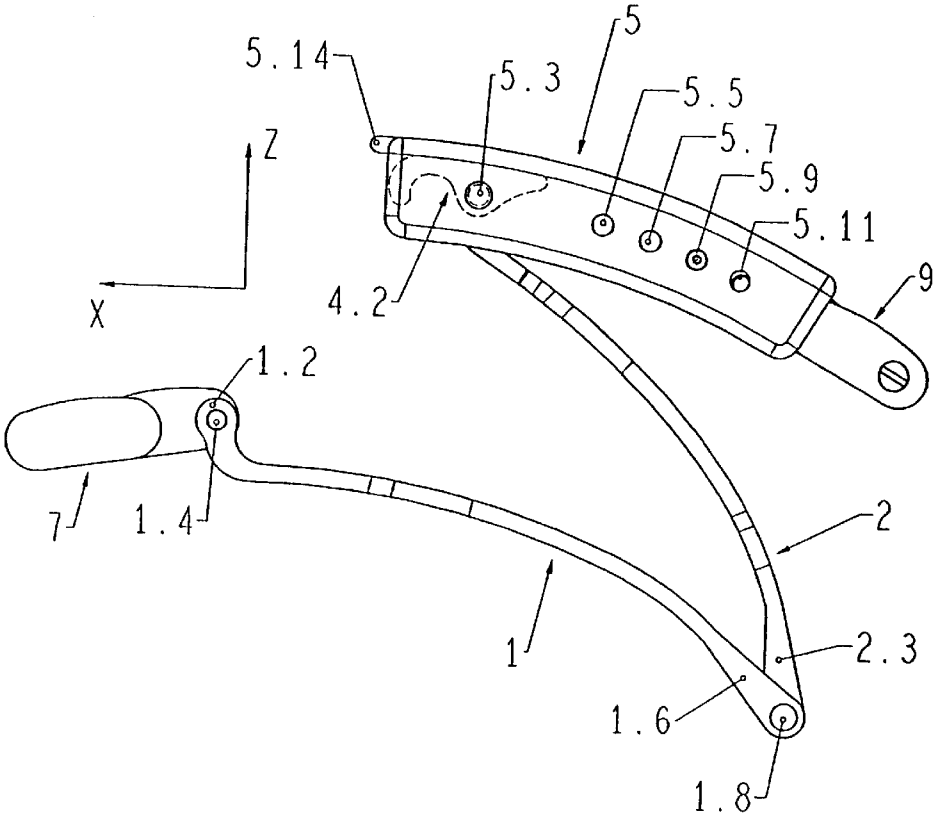

FIG. 7 A aide view of the open folding fastener of FIG. 5 or 6.

Figure 8:
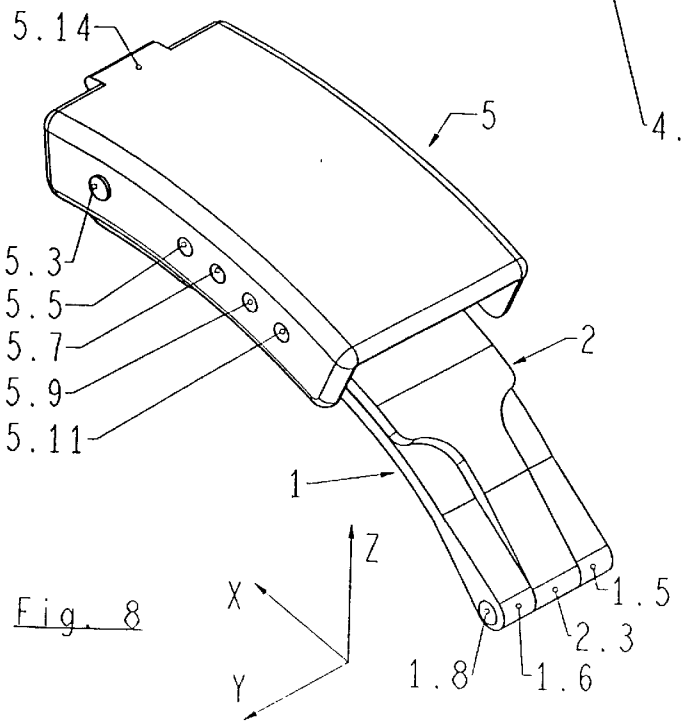

FIG. 8 A perspective view of the locked folding fastener.

Figure 9:
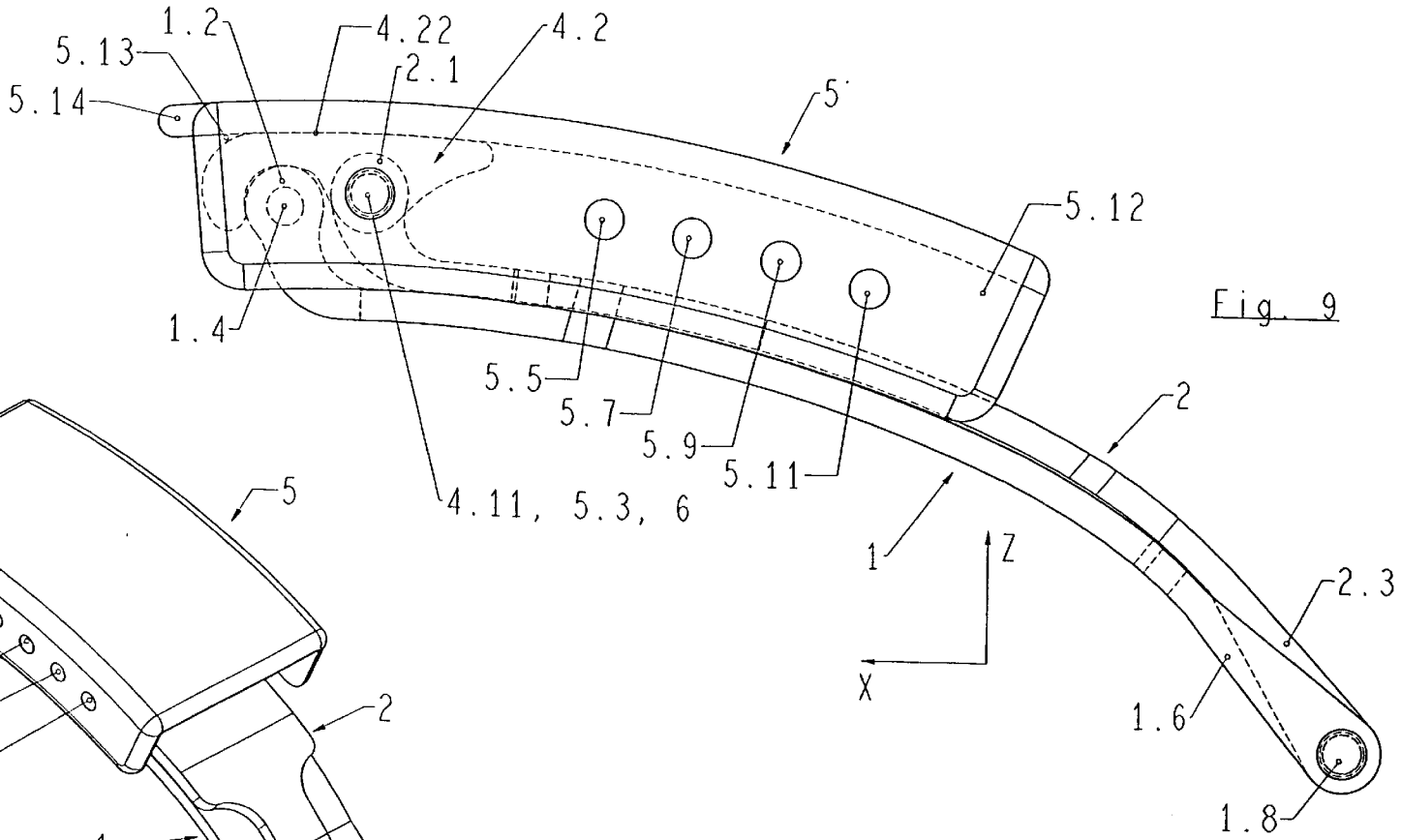

FIG. 9 A aide view of the locked folding fastener of FIG. 8 with partly transparent components.

Figure 10:
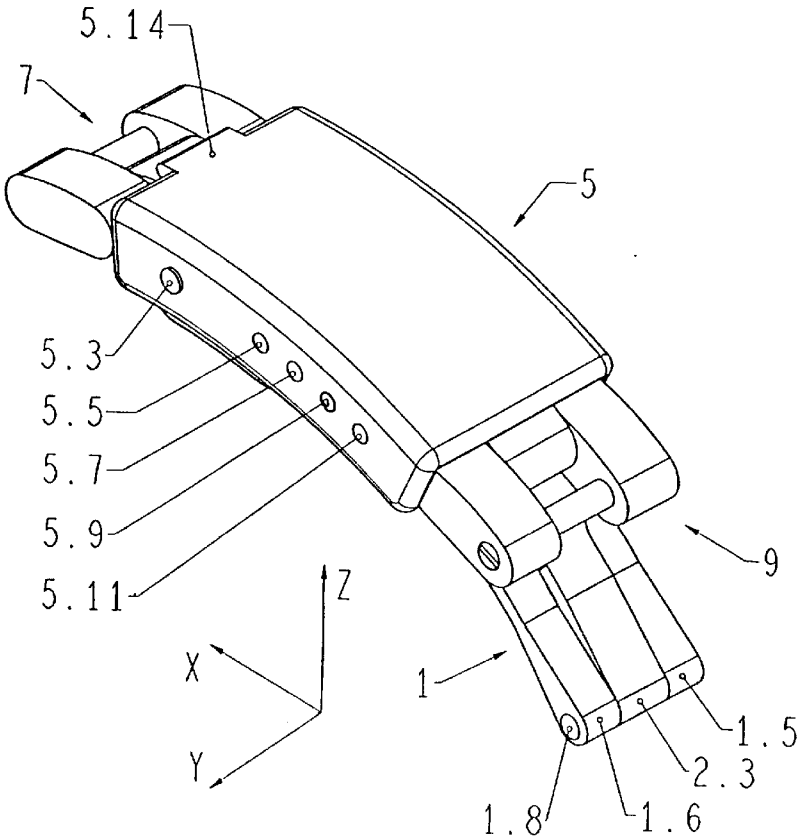

FIG. 10 Like FIG. 8, but additionally with strap members.

Figure 11:
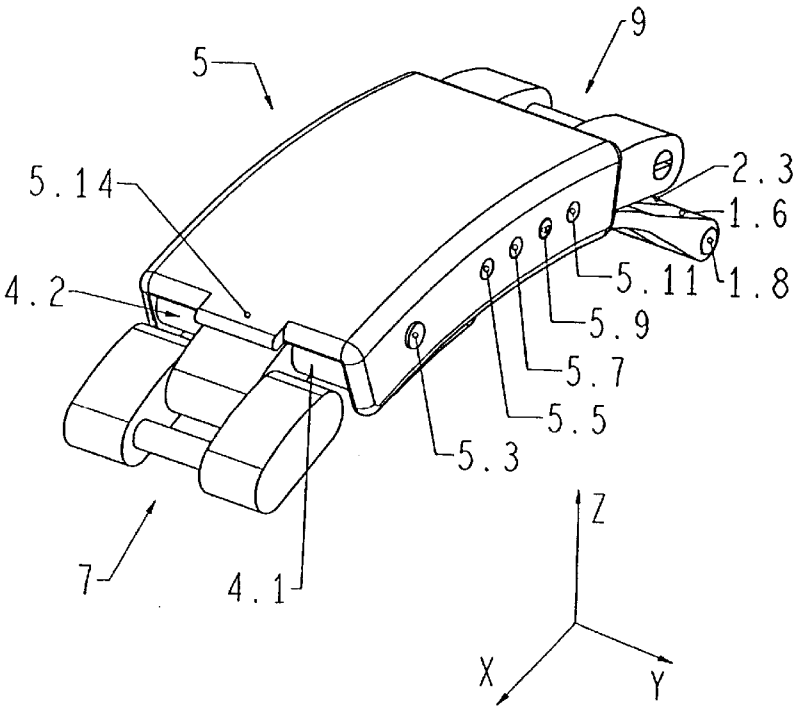

FIG. 11 Like FIG. 10, but from a different perspective.

Figures 12, 13, 14:
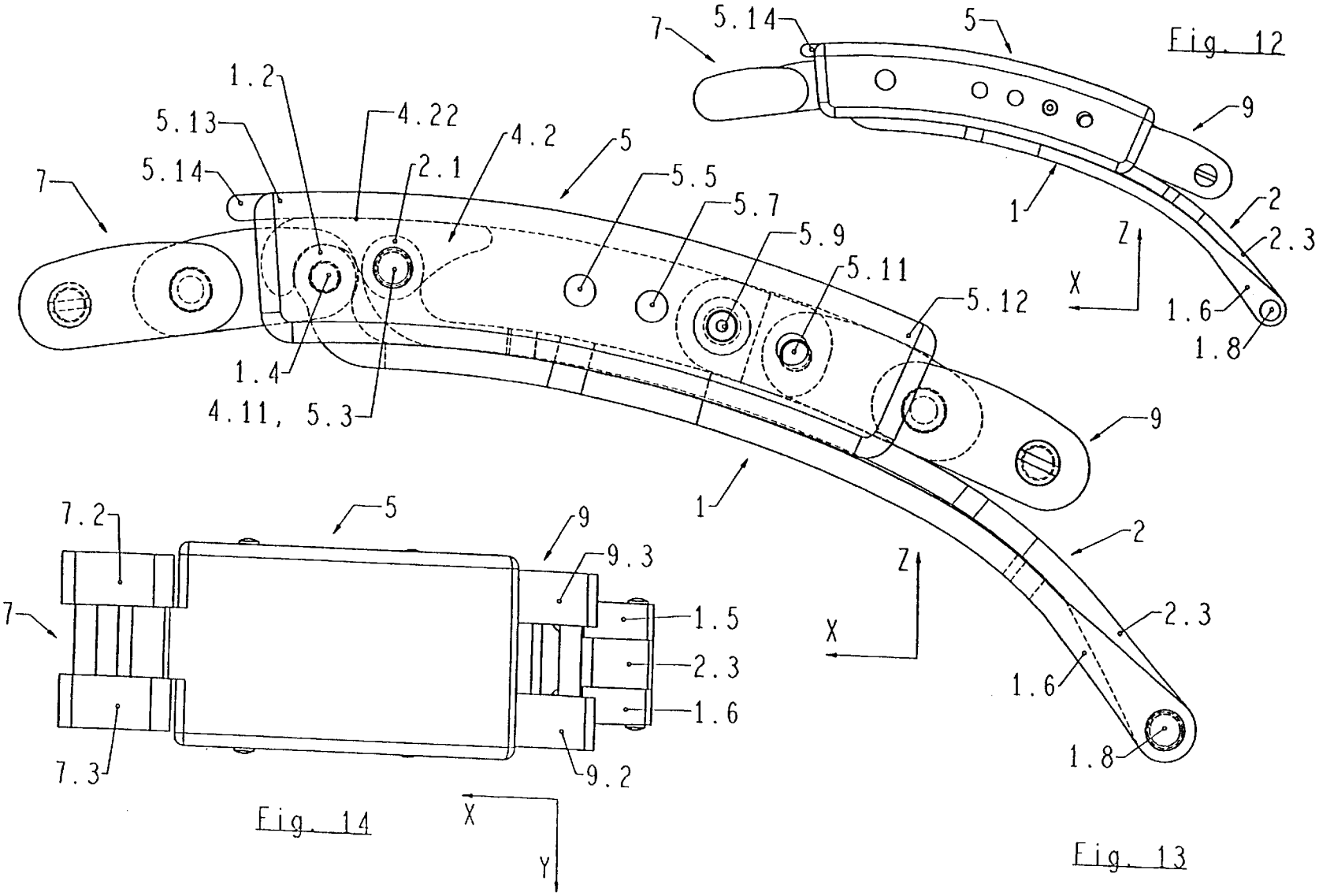

FIG. 12 A side view of the locked folding fastener of FIGS. 10 or 11.

FIG. 13 Like FIG. 12, with partly transparent components.

FIG. 14 A plan view of the locked folding fastener of FIGS. 10, 11, 12 and 13.

Figure 15:
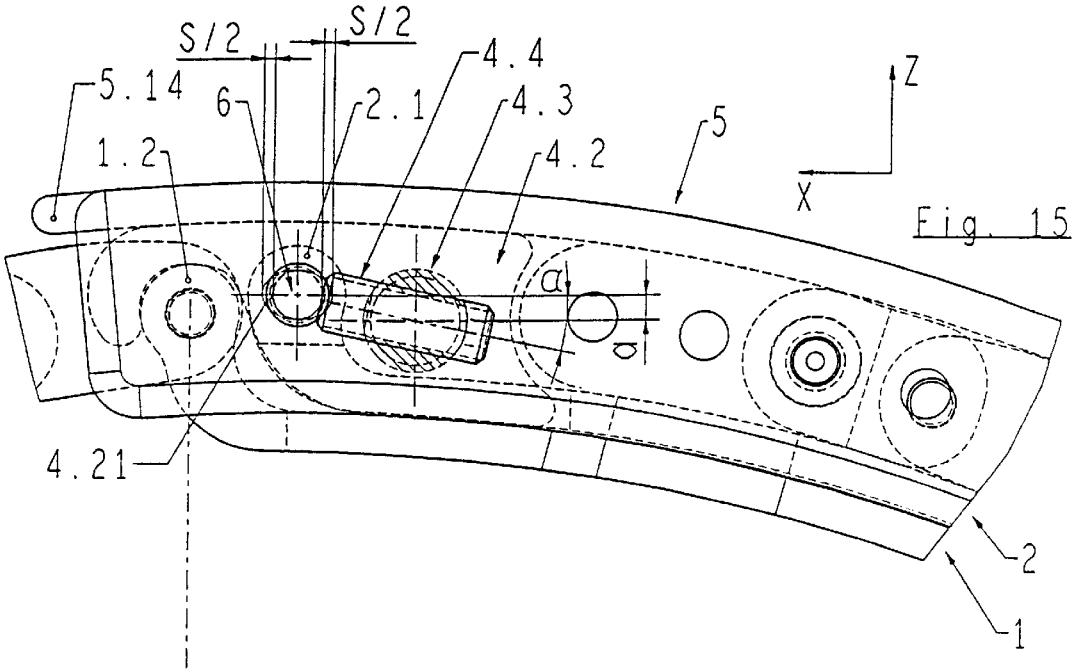

FIG. 15 A side view of part of the locked folding fastener with a mechanism for the fine setting of the locking pressure.

Figure 16:
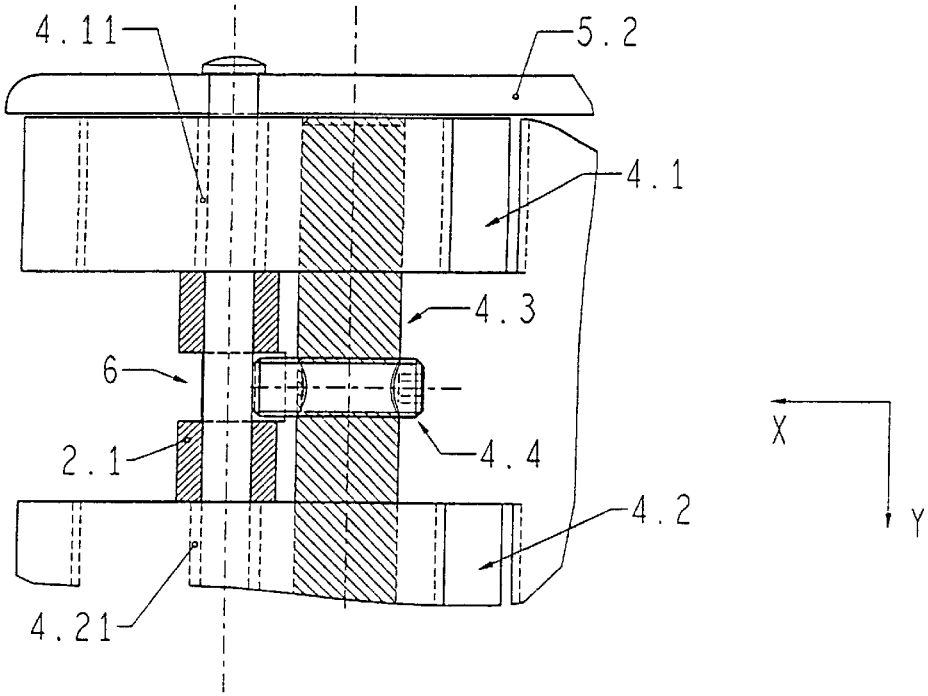

FIG. 16 A plan view of part of the folding fastener of FIG. 15.

Figure 17:
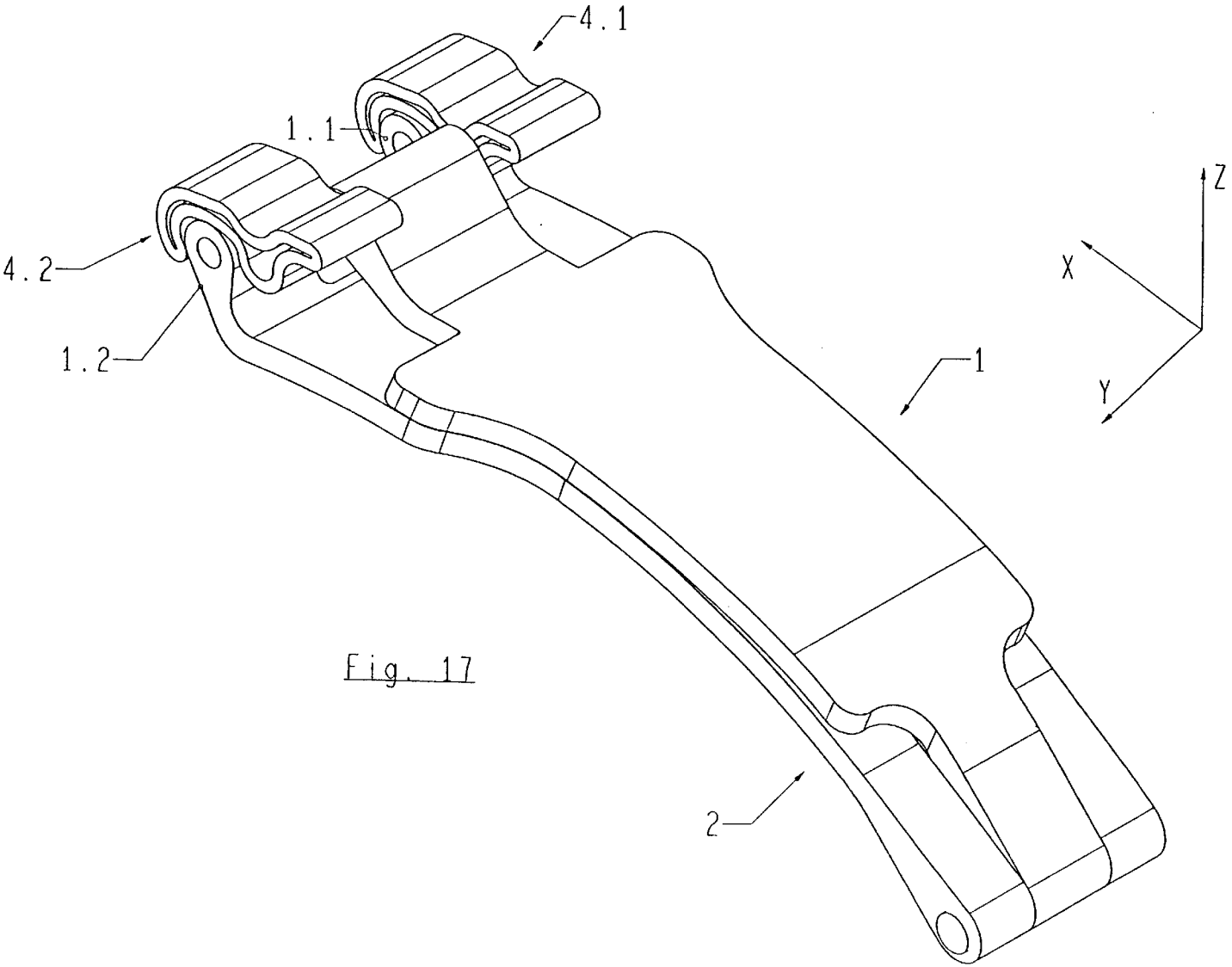

FIG. 17 A perspective view of another embodiment of the folding fastener with a locking mechanism having elastic claws.

Figure 18:
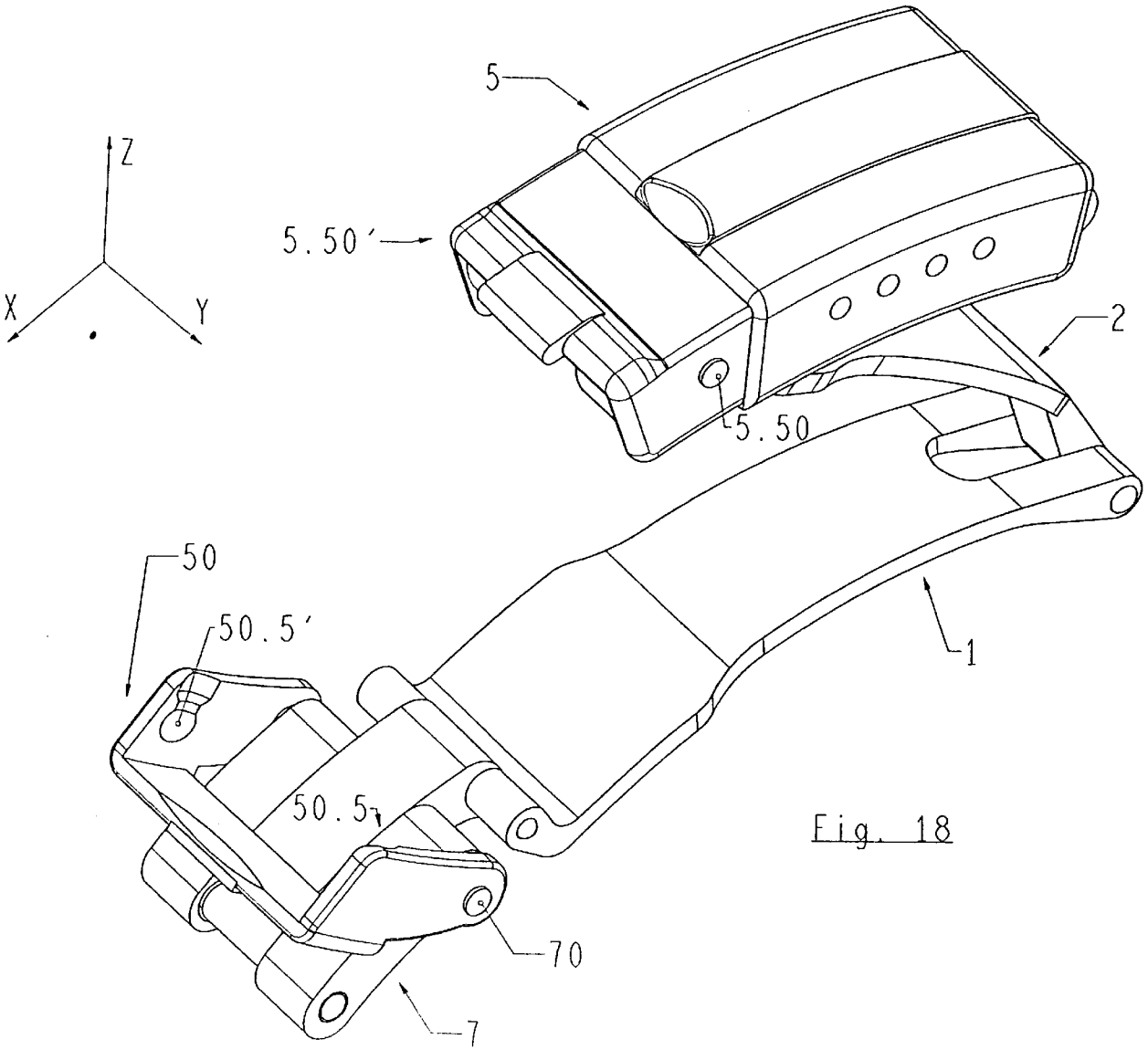

FIG. 18 A perspective view of another embodiment of the open folding fastener with a security cover.

Figure 19:
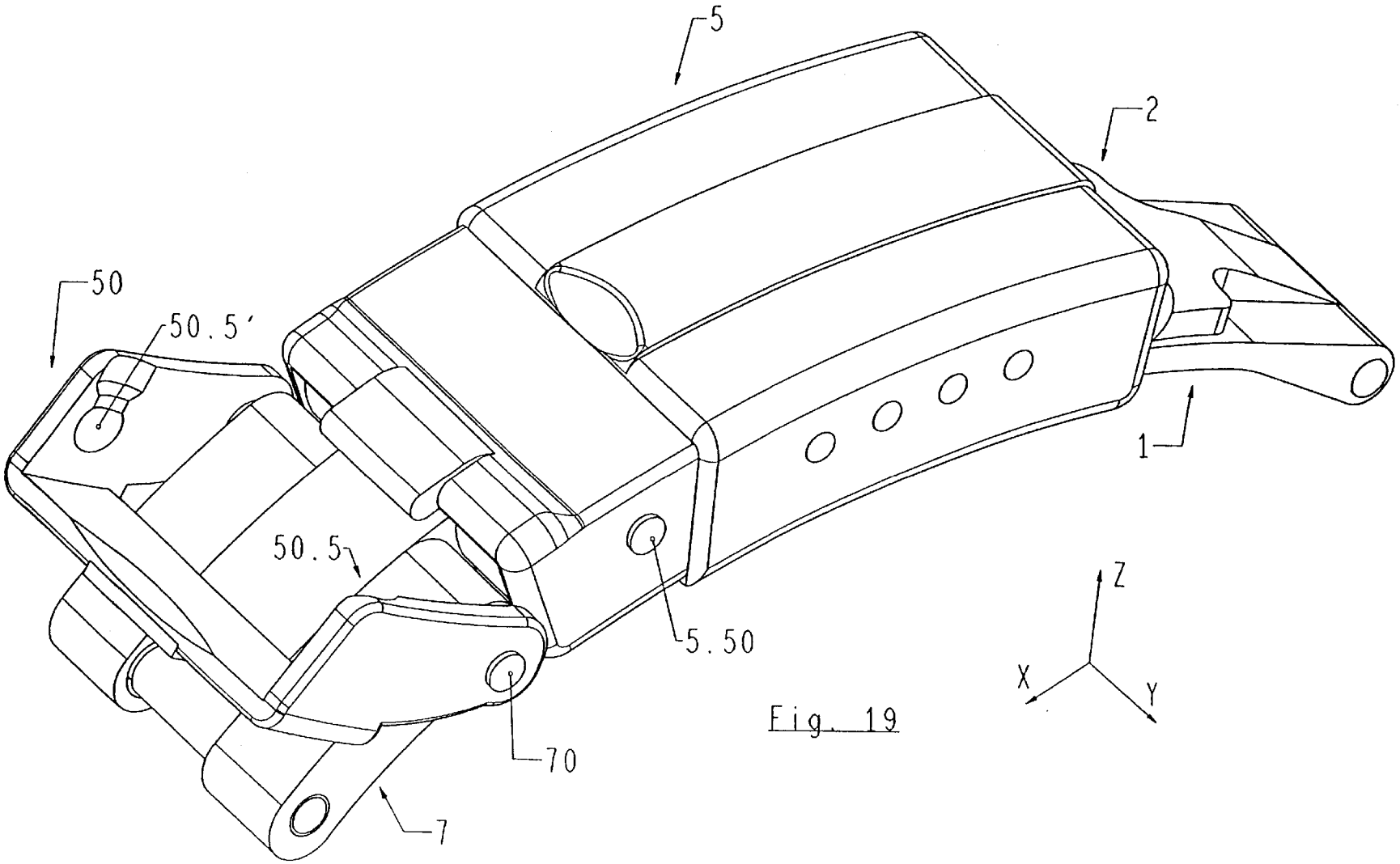

FIG. 19 like FIG. 18, but of the locked folding fastener and with an open security cover.

Figure 20:
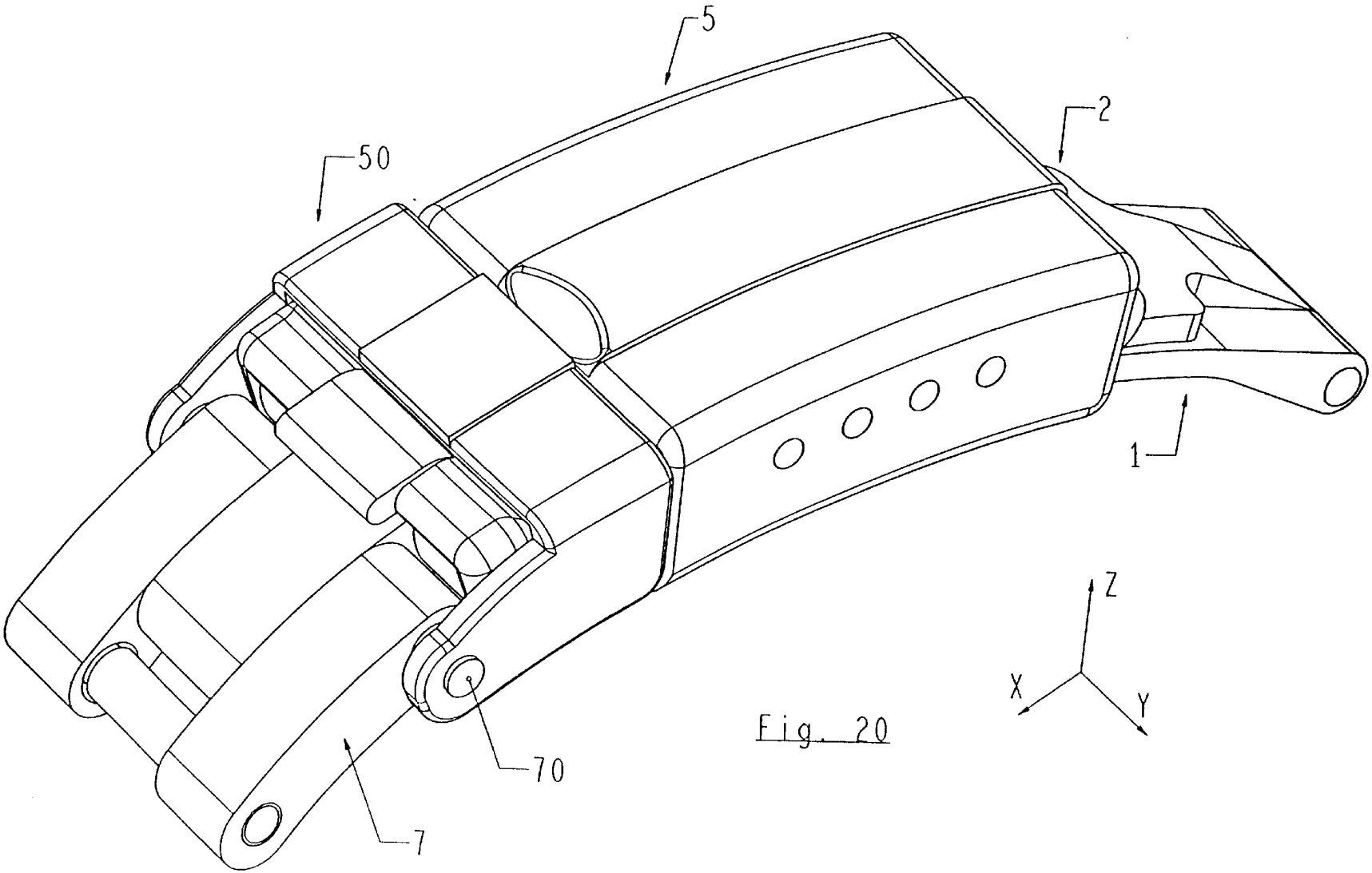

FIG. 20 like FIG. 19, but of the locked folding fastener and with a locked security cover.

Figure 21:
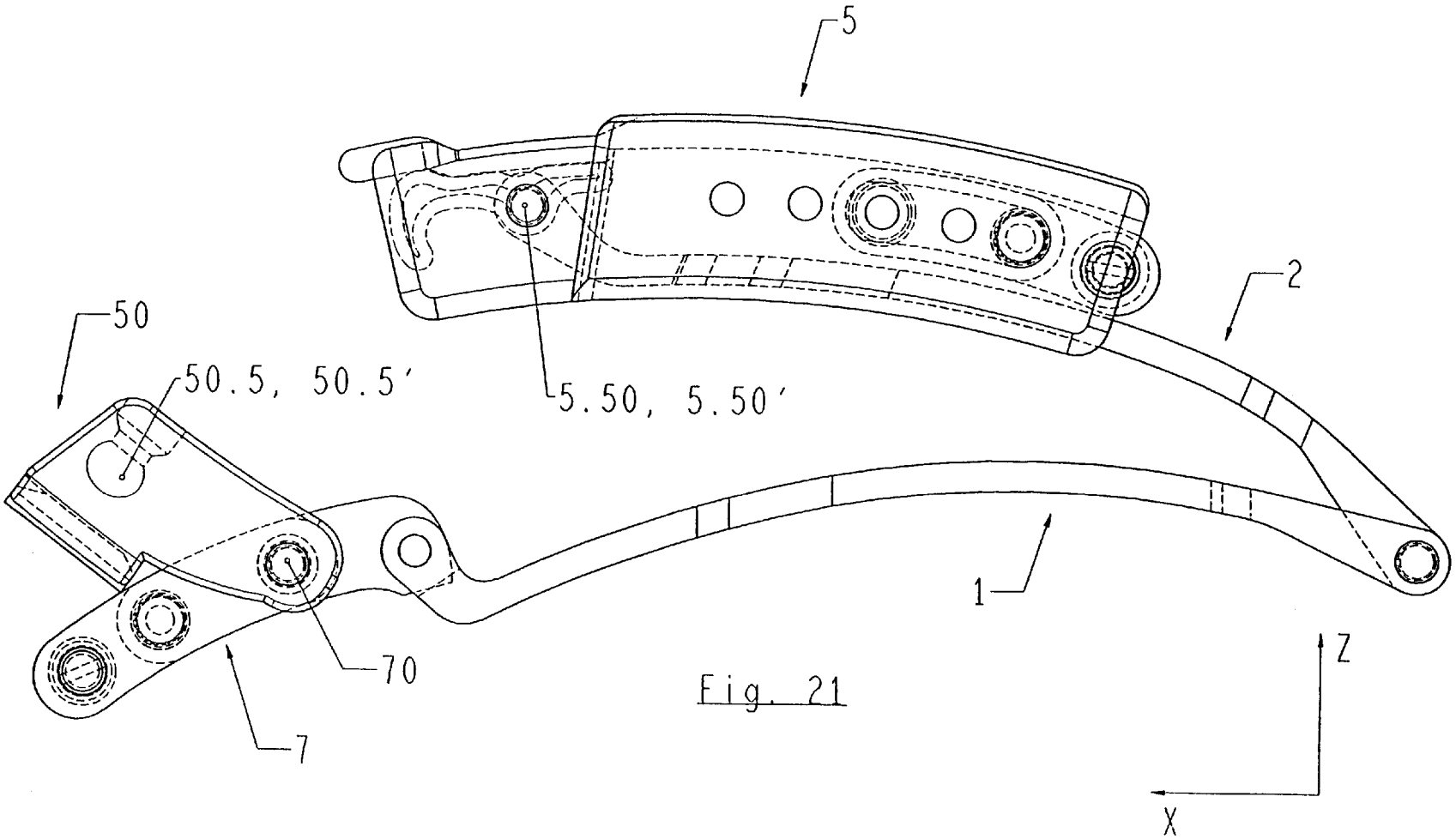

FIG. 21 A side view of another embodiment of the open folding fastener with a security cover, like FIGS. 18 to 20 with partly transparent components.

Figure 22:
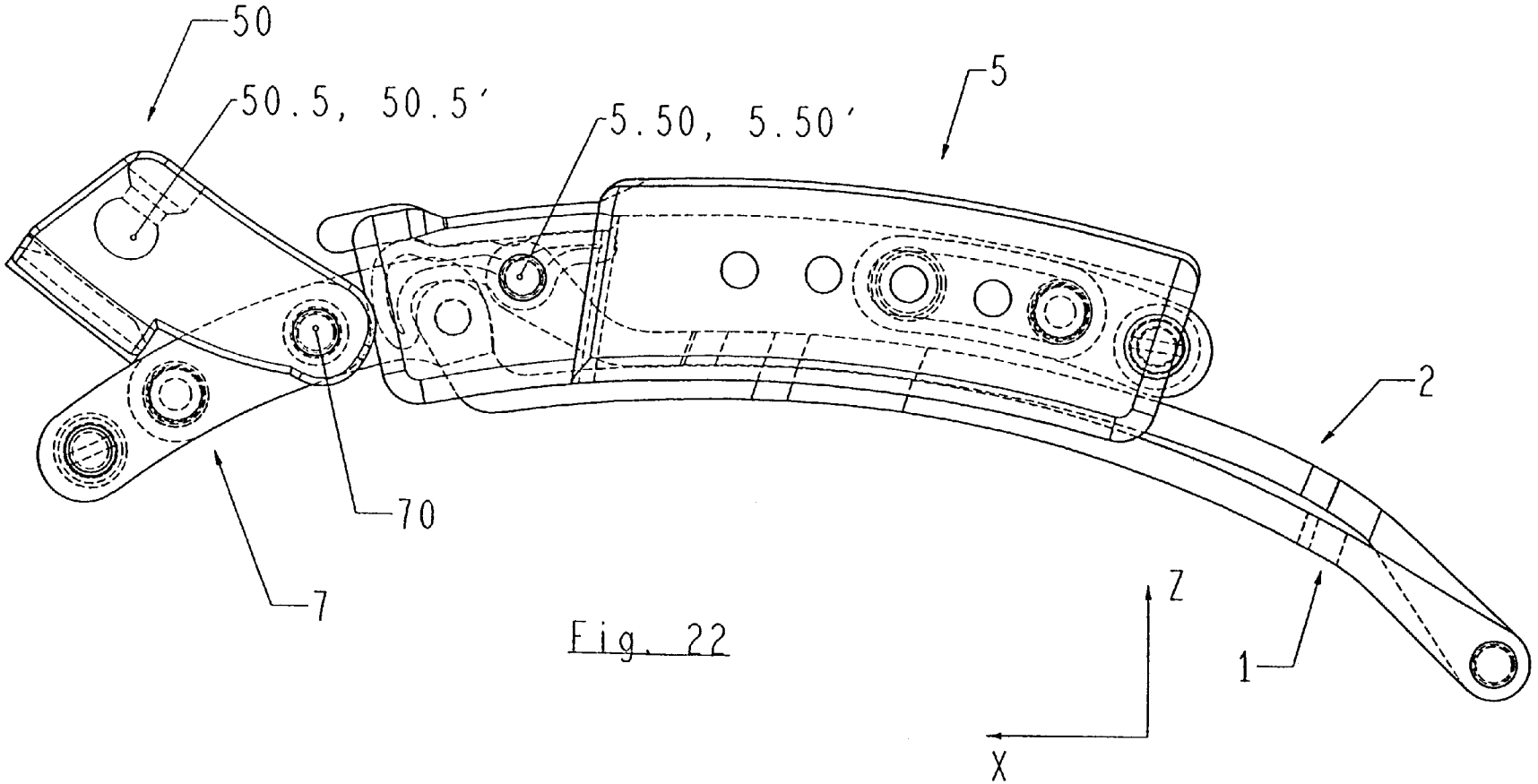

FIG. 22 like FIG. 21, but of the locked folding fastener and with an open security cover.

Figure 23:
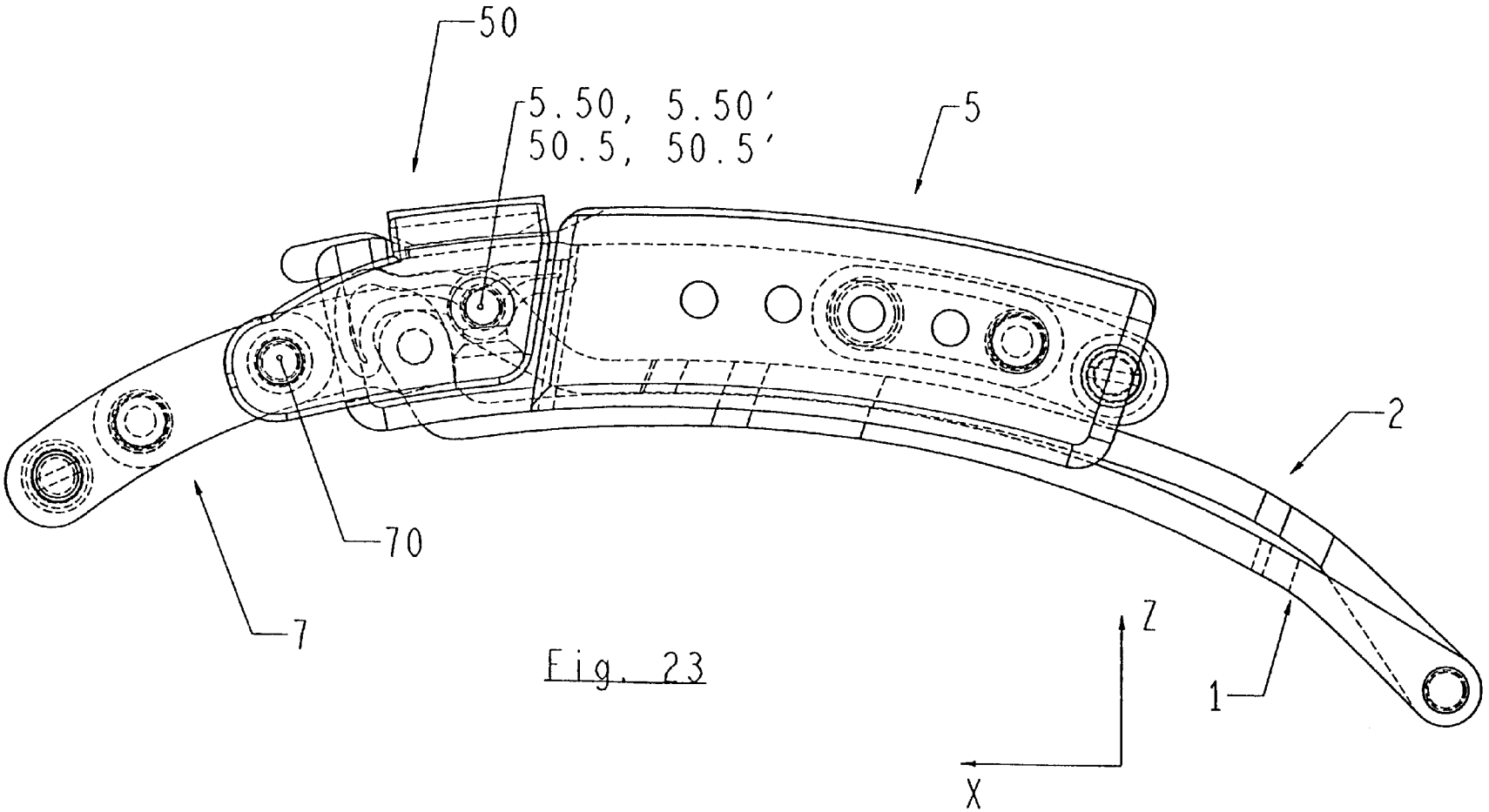

FIG. 23 like FIG. 22, but of the locked folding fastener and with a locked security cover.

In all the drawings is shown a Cartesian coordinate system (x, y, z), in which x represents the longitudinal direction, in which the watch strap runs in the vicinity of the folding fastener. If reference is made herein to the "front" end of a component, this is understood to mean the end pointing in the +x direction and conversely the "rear" end is that and pointing in the −x direction. In addition, "top" is linked with the +z direction and "bottom" with the −z direction.

FIG. 1 shows in perspective form an embodiment of the inventive folding fastener broken down into components. The components are preferably made from metal, e.g. stainlees steel, but other materials are also possible. The inventive folding fastener has a lockable folding clasp, which comprises a first clasp part 1 and a second clasp part 2. The two clasp parts 1, 2 are thick, i.e. they have a relatively large extension in the z direction, so that they are solid and stiff with respect to expansion in the x direction and bending about the y axis. This makes the folding fastener secure against undesired opening through external forces and/or torques.

The front end of the first clasp part 1 is connected in the manner of a hinge to a first watch strap half 7. In the present document the term "witch strap half" merely means Part of the strap, which need not represent exactly half the entire strap length or half of the total number of strap members. The first strap half 7 points at 6 o'clock of a not shown watch fixed to the strap and is only partly represented in the form of a tow strap members 7.1–7.3. The last strap member 7.1 comes to rest between two upwardly bent, i.e. in the z direction, shapes 1.1, 1.2 at the end of the first clasp part 1. The last strap member 7.1 and the shapes 1.1, 1.2 are provided with holes 1.3, 1.4 and are connected in rotary manner by a pin 8.

The two clasp parts 1, 2 are connected in rotary manner to one another at their rear ends in the form of a hinge. Such a hinge is e.g. formed by matching shapes 1.5, 1.6, 2.3 on the rear ends of the two clasp parts 1, 2. The shapes 1.5, 1.6, 2.3 are provided with holes 1.7, 1.8, 2.4, in which can be inserted a pin 3.

At their free, i.e. front ends, the two clasp parts 1, 2 have a locking mechanism with which they can be positively and reversibly interconnected. In the presently explained, preferred embodiment the locking mechanism comprises two, upwardly bent shapes 1.1, 1.2 at the front end of the first clasp part 1 and two claws 4.1, 4.2, which are fixed to the front end of the second clasp part 2 and correspond with respect to their position to the shapes 1.1, 1.2. The rotary fixing of the claws 4.1, 4.2 also takes place in this embodiment in the manner of a hinge with a pin 6, which is engaged through holes 4.11, 4.21 in the claws 4.1, 4.2 and through a hole 2.2 in an upwardly bent shape 2.1 in the second clasp part 2 located between the claws 4.1, 4.2.

If a force is exerted from above i.e. in the z direction, on the claws 4.1, 4.2 and/or the second clasp part 2 and a corresponding opposing force acts on the first clasp part 1, then the shapes 1.1, 1.2 on the first clasp part 1 are initially bent by the claws 4.1, 4.2 slightly rearwards, i.e. in the x direction. As soon as the inner shape of the claws 4.1, 4.2 again allows a slight forward movement of the shapes 1.1, 1.2, the claws 4.1, 4.2 snap over the shapes 1.1, 1.2, which gives a positive connection between the two clasp parts 1, 2. A locked clasp is inter alia shown in FIGS. 2 to 4. The connection is reversible and can be cancelled out by a force in the z direction on the second clasp part 2 and a corresponding opposing force on the first clasp part 1. FIGS. 2 to 4 show how the two clasp parts 1, 2 and their hinge-like connection are matched to one another, so that they form a substantially continuous unit in the folded together state. This unit has a slightly curved configuration, the radius of curvature r roughly corresponding to the expected arm radius of a potential strap wearer. When wearing the strap the first clasp part I is located on the arm or wrist.

The locking mechanism could also be differently implemented. In a first variant there could only be e.g. one central claw and correspondingly only one central shape on the first clasp part 1, but two shapes on the second clasp part 2. This variant would be simpler, but would be less favourable as regards security, stability and rotations about the z axis than the preferred embodiment shown in the drawings. In a second variant the claws could be shaped directly from the second clasp part 2, in much the same way as the central shape 2.1, but bent downwards. In a third variant the claws could be fixed to or shaped from the first clasp part 1. Combinations of these variants are naturally also possible.

The preferred embodiment of the invention also has a closure or fastener cover or cap 5, which is preferably open to the front and rear, i.e. in the x and −x direction. On the sides it has wrapped round edges 5.1, 5.2. The rotary fixing of the closure cover to the second clasp part 2 preferably takes place with the same pin 6 as is used for fixing the claws 4.1, 4.2 to the second clasp part 2. For receiving the pin 6 the two lateral edges 5.1, 5.2 of the cover 5 are provided with in each case one hole 5.3.

The edges 5.1, 5.2 of the closure cover 5 also have a plurality of further, juxtaposed holes 5.5, 5.7. 5,9, 5.11. They are used for the rotary fixing of a second strap half 9, which is once again only partly shown in the form of a few strap members 9.1–9.3. This second strap half points to 12 o'clock of a not shown watch fixed to the strap. It is possible to provide a separate end member 9.4, which at least rearwards, i.e. in the −x direction, has the same appearance as a normal strap member. Such an end member can e.g. be advantageous for increasing stability and strength. The end member 9.4 receives a spring pin 10, which can be inserted in the holes 5.5, 5.7, 5.9, 5.11 in the cover 5. The numerous holes 5.5, 5.7, 5.9, 5.11 permits a fine setting of the strap circumference.

FIGS. 5 to 7 show different views of a preferred embodiment of the inventive folding fastener with a few strap members in the open, but not completely folded apart state. In FIG. 7 the closure cover 5 is shown in partly transparent form, so that one claw 4.2 is visible.

FIGS. 8 to 14 show various views of a preferred embodiment of the inventive folding fastener in the locked state. In FIGS. 9 and 13 the closure cover 5 is shown in partly transparent form, so that a claw 4.2 is visible. The drawings make it particularly clear the functional interaction of claws 4.1, 4.2 and closure cover 5. The claw 4.2 projects forwards over and beyond its pin 6, i.e. in the x direction and the shape of its top 4.22 is adapted to the cover 5. This construction makes it impossible for the locking system to be opened by lifting (in the z direction) the rear end 5.12 of the closure cover 5. An opening of the locking system is only possible through raising (in the z direction) the front end 5.13 of the closure cover 5. For this purpose the end 5.13 can be provided with a shape 5.14 as a grip. However, it is important that in the inventive folding fastener the cover 5 does not contribute to the actual locking.

FIGS. 11 and 14 show particularly clearly the optical impression simulated by the locked, inventive folding fastener. The viewer thinks that the strap 7, 9 passes uninterruptedly under and through the closure cover 5 and that the latter is merely placed on the strap 7, 9. This impression results from two technical measures. Firstly the shapes 1.1, 1.2 on the first clasp part 1, to which the first strap half 7 is fixed, are bent upwards, i.e. in the z direction. Therefore the first strap half 7 is located immediately below the closure cover 5, as is also the second strap half 9. In other words there is no height difference in the z direction between the fastenings of the first strap half 7 and the second strap half 9. In addition, the partly visible front ends of the claws 4.1, 4.2 have the same appearance as the strap members 7.2., 7.3. The illusion of the strap 7, 9 passing continuously under the closure cover 5 is reinforced by the fact that the front end and rear end of the cover are open, i.e. allow a free view of the strap 7, 9 or claws 4.1, 4.2.

It can be advantageous to provide a mechanism for the fine setting of the locking pressure. With such a mechanism it is possible to displace the claws 4.1, 4.2 relative to the corresponding shapes 1.1, 1.2 substantially in the x direction by at least a small distance. The implementation of such a fine setting can e.g. take place in the manner shown in FIGS. 15 and 16. The claws 4.1, 4.2 have a modified configuration, so that they can receive an additional connecting pin 4.3. Instead of being connected to the connacting pin 4.3, the claws 4.1, 4.2 could also be made from one piece and be interconnected at their rear ends by a connecting web. Into the connecting pin 4.3 can be screwed a setscrew 4.4, whose front end acts on the pin 6 exposed at this point. In this variant the holes 4.11, 4.21 are slightly oval, their extension in the x direction being greater than their extension in the z direction. Thus, the claws 4.1, 4.2 can at the most be displaceable by a distance s in the x direction.

By turning the setscrew 4.4, the claws 4.1, 4.2 can consequently be displaced in the x direction relative to the corresponding shapes 1.1, 1.2, so that the locking pressure can be finely set or adjusted. If the setscrew 4.4 so screwed forwards, i.e. its end to displaced in the x direction, the locking pressure is increased, and vice versa.

In another, not shown variant, a setscrew could be fitted in each claw 4.1, 4.2, so that no connection 4.3 would be necessary between said claws. With the knowledge of the present invention, it to easily possible for the expert to derive other fine setting mechanism.

In another preferred embodiment of the folding fastener shown for example in FIG. 17, the locking mechanism comprises two elastic claws 4.1, 4.2. Said elastic claws are made for example from oblong tubes. Such oblong tubes are deformed in a way to result in claws 4.1, 4.2 forming a strip around a cavity. Advantageously, each claw is deformed in a way to form a closed double strip around a central cavity. This double strip has string characteristics while snapping over the shapes 1.1, 1.2. The elasticity of the claws can be varied in function of the tube material chosen. A person skilled in the art which knows the present invention can realize other variations of such a locking mechanism with elastic claws.

FIGS. 18 to 23 show perspective and side views of still another preferred embodiment of a folding fastener. Said folding fastener corresponds to this one according to FIGS. 1 to 16, but having a security cover 50 for prevention of an undesirable opening of the fastener. FIGS. 18 and 21 show the open folding fastener with an open security cover, FIGS. 19 and 22 show the closed folding fastener with an open security cover and FIGS. 20 and 23 show the closed folding fastener with a closed security cover. In order to close the security cover 50, an additional snapping occurs while folding up the security cover onto the closure cover 5. The security cover 50 is mounted, for example by means of a pin 6, in a mobile way on the strap 7. The security locking comprises, for example, one or more concave portions 50.5, 50.5' of the security cover 50 for a snap over one or more corresponding convex portions 5.50, 5.50' of the closure cover 5. A person skilled in the art which knows the present invention can realize other variations, which are not shown, of such a security locking without leaving the frame of the present invention.

What is claimed is:

1. A folding fastener for closing a strap comprising a first strap half and a second strap half, having a lockable folding clasp which comprises a first clasp part and a second clasp part, a closure cover and a locking mechanism, the first strap half being fixed to the first clasp part, the second strap half being fixed to the closure cover and the second clasp part connecting the first clasp part pivotally to the closure cover, wherein the clasp parts are substantially rigid with respect to longitudinal extension and/or bending under the application of external forces encountered in normal use of said clasp and wherein the locking mechanism comprises at least one claw which is fixed or shaped on the second clasp part, and at least one corresponding shape on the first clasp part, said shape being resilient under the application of external forces encountered in normal use of said clasp, wherein in the locked state the at least one claw engages the at least one corresponding shape and thus brings about a positive, reversible connection between the first clasp part and the second clasp part.

2. A folding fastener according to claim 1 wherein the clasp parts are thick and solid.

3. A folding fastener according to claim 1, wherein the two clasp parts are pivotally interconnected at one of their ends respectively.

4. A folding fastener according to claim 3, wherein the two clasp parts and their pivotal connection are so matched to one another that in the folded together state they form a substantially continuous unit.

5. A folding fastener according to claim 1, wherein the at least one claw is fixed or shaped on a free end of the second clasp part.

6. A folding fastener according to claim 5, wherein the at least one claw is pivotally connected to the second clasp part.

7. A folding fastener according to claim 6, wherein the at least one claw and the closure cover are pivotally connected to the second clasp part by the same pin.

8. A folding fastener according to claim 6, characterized in that it contains two claws, which are pivotally connected to one side respectively of a central, upwardly bent shape at the free end of the second clasp part by a pin and that the first clasp part has two upwardly bent shapes corresponding to the two claws.

9. A folding fastener according to claim 1, characterized in that it contains two claws, which are pivotally connected to one side respectively of a central, upwardly bent shape at the free end of the second clasp part by a pin and that the first clasp part has two upwardly bent shapes corresponding to the two claws.

10. A folding fastener according to claim 9, wherein the two claws are interconnected by an additional connecting pin or by a connecting web.

11. A folding fastener according to claim 10, wherein the closure cover is pivotally connected to the second clasp part.

12. A folding fastener according to claim 11, wherein the at least one claw and the closure cover are pivotally connected to the second clasp part by the same pin.

13. A folding fastener according to claim 12, wherein the locking system of the folding clasp is detachable by exerting tension on a front end of the closure cover.

14. A folding fastener according to claim 1, wherein the closure cover is pivotally connected to the second clasp part.

15. A folding fastener according to claim 1, wherein the locking system of the folding clasp is detachable by exerting tension on a front end of the closure cover.

16. A folding fastener according to claim 15, wherein the at least one claw is designed and positioned to prevent a release of the folding clasp locking system for as long as no tension is exerted on the front end of the closing cover.

17. A folding fastener according to claim 16, wherein the first strap half is pivotally connected to the at least one corresponding shape on the first clasp part.

18. A folding fastener according to claim 17, wherein the second strap half is pivotally connected to the closure cover.

19. A folding fastener according to one of the claim 18, wherein in the locked state the fastenings of the first strap half and second strap half are located directly below the closure cover and that the front ends of the claws have the same appearance as the strap members, to give an impression that the strap passes continuously beneath the closure cover.

20. A folding fastener according to claim 19, wherein for the fine setting of the locking pressure, the at least one claw is displaceable by at least a short distance relative to the corresponding shapes on the first clasp part.

21. A folding fastener according to claim 1, wherein the first strap half is pivotally connected to the at least one corresponding shape on the first clasp part.

22. A folding fastener according to claim 1, wherein the second strap half is pivotally connected to the closure cover.

23. A folding fastener according to claim 1, wherein in the locked state, connections of the first strap half and second strap half are located directly below the closure cover and that the front ends of the claws have the same appearance as the strap members, to give the impression that the strap passes continuously beneath the closure cover.

24. A folding fastener according to claim 1, wherein for the fine setting of the locking pressure, the at least one claw is displaceable by at least a short distance relative to the at least one corresponding shape on the first clasp part.

25. A folding fastener according to claim 1, comprising a security cover for a security locking while folding up the security cover into the closure cover.

* * * * *